US005626465A

United States Patent [19]

Thoma

[11] Patent Number: 5,626,465

[45] Date of Patent: May 6, 1997

[54] HYDRAULIC PISTON MACHINES

[75] Inventor: Christian H. Thoma, Jersey, Great Britain

[73] Assignee: Unipat AG, Glarus, Switzerland

[21] Appl. No.: 354,897

[22] Filed: Dec. 9, 1994

[30] Foreign Application Priority Data

Dec. 15, 1993 [GB] United Kingdom ..... 9325631
Oct. 19, 1994 [GB] United Kingdom ..... 9421103

[51] Int. Cl.[6] ..... F04B 1/04

[52] U.S. Cl. ..... 417/273; 91/491

[58] Field of Search ..... 29/888.02; 417/273, 417/219, 220; 91/491, 497

[56] References Cited

FOREIGN PATENT DOCUMENTS 9224046 12/1993 United Kingdom .

WO93/24734 12/1993 WIPO .

*Primary Examiner*—Timothy Thorpe
*Assistant Examiner*—Peter G. Korytnyk
*Attorney, Agent, or Firm*—Young & Thompson

[57] ABSTRACT

A housing for a hydraulic piston machine comprising two shells of part-cylindrical form, the shells connectable together along a parting plane in which the rotating axis of the drive-shaft lies to contain within internal working elements of the machine. Either or both housing shells may be provided with a opening connecting the interior to the exterior of the shell(s) to provide means for fluid distribution of the machine. A non-deformable liner-element located within one or more of said openings for isolating pressurized fluid passing through the machine from coming into direct contact with the housing shells.

20 Claims, 6 Drawing Sheets

FIG.5
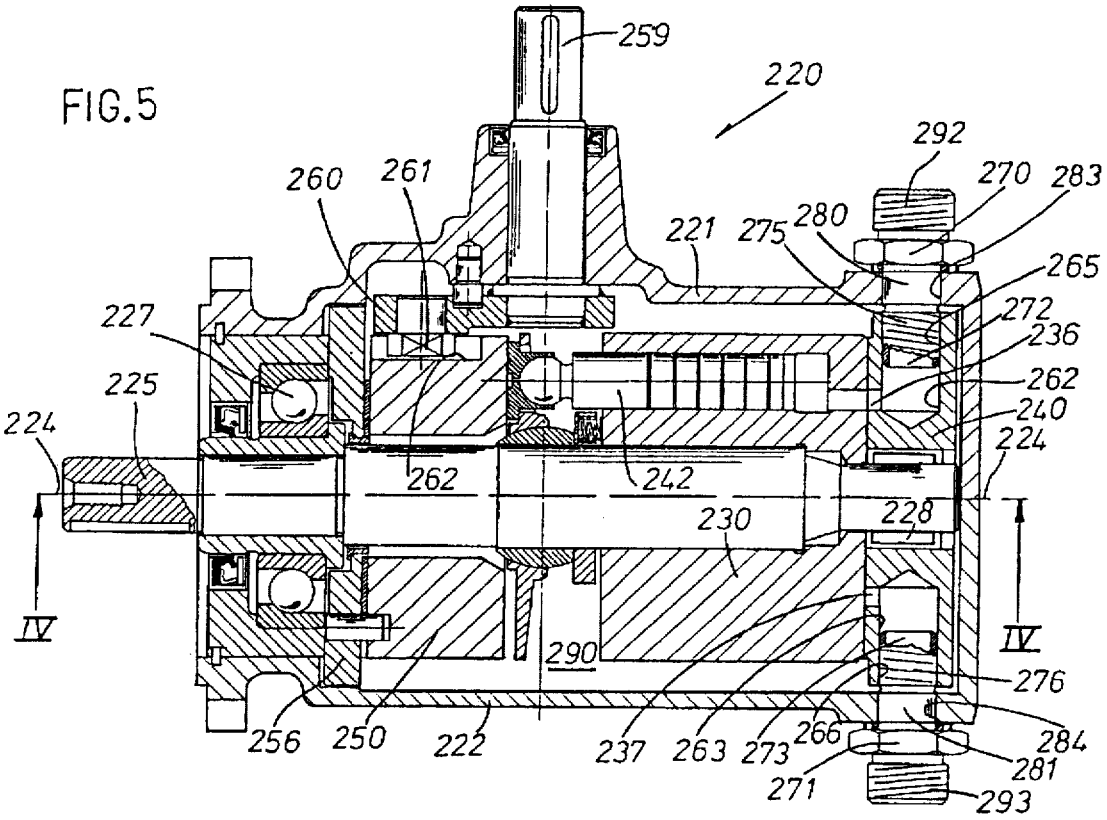
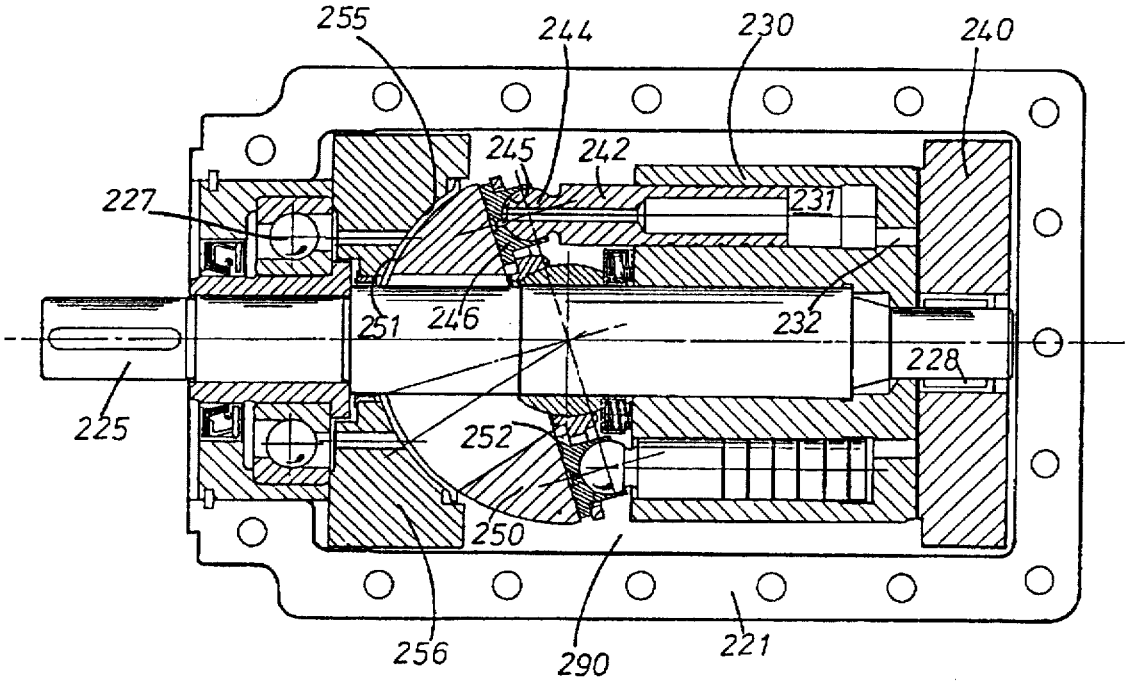
FIG.6

FIG.7
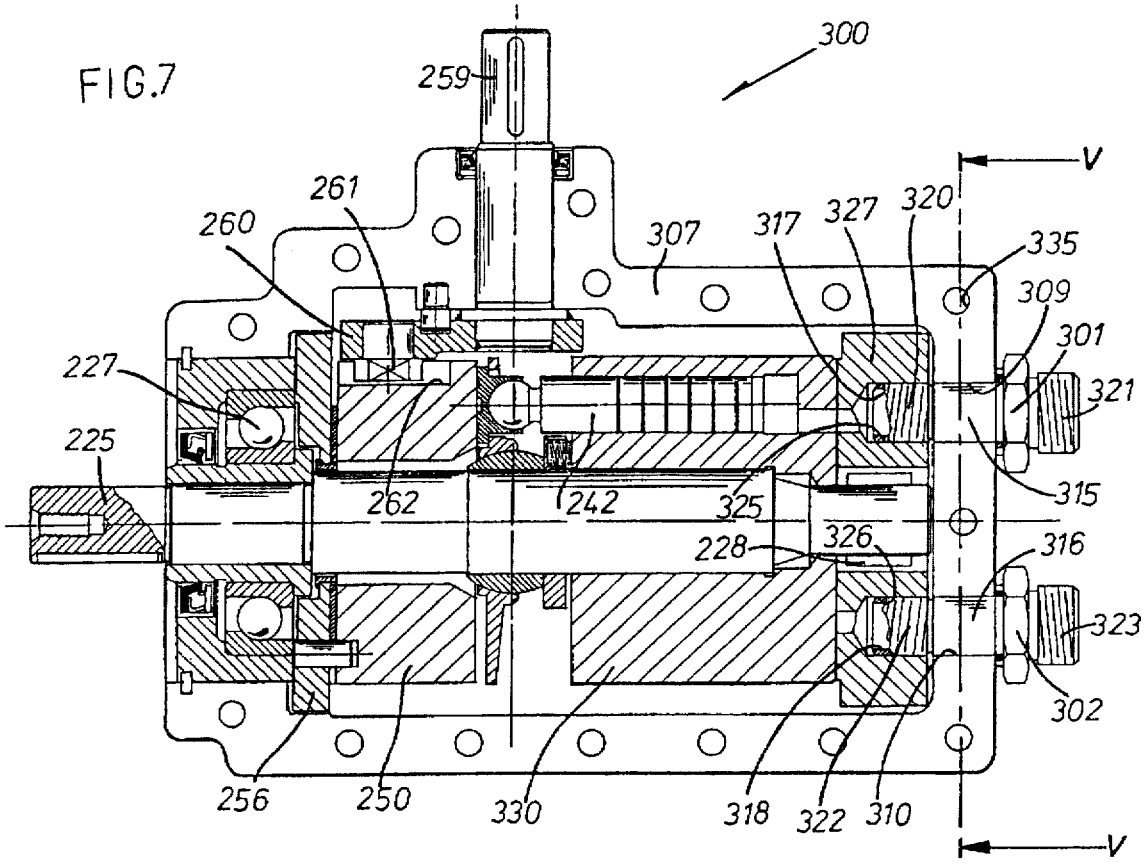
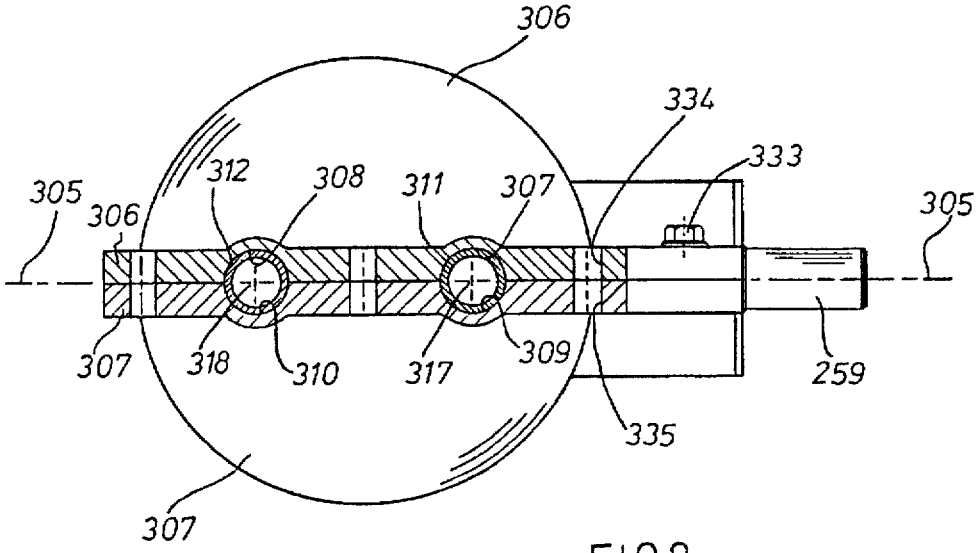
FIG.8

HYDRAULIC PISTON MACHINES

FIELD OF THE INVENTION

This invention relates to hydrostatic rotary hydraulic piston machines of the positive displacement pressure-fluid type, and is particularly directed at further improvements to machines having a housing structure formed by two interconnecting shells, for example, of the type shown and described in our pending International Application No. PCT/GB-93/01051.

In the case of a radial piston type of hydraulic machine, a cylinder-barrel is mounted for rotation on a ported pintle-valve, and is provided with a number of generally radial cylinder-bores. Each cylinder-bore contains a piston and each piston is operatively engaged to a surrounding annular track-ring. Arcuate-ports provided in the pintle-valve are arranged to communicate with fluid inlet and outlet conduits attached to the exterior of the machine, and thus rotary movement of the cylinder-barrel is accompanied by radial displacement of the pistons and corresponding displacement of fluid through these fluid conduits. A control-system may be included which acts in determining the degree of eccentricity required between the track-ring and pintle-valve, and therefore regulates the supply of hydraulic fluid output from the hydrostatic machine to meet the varying fluid demand of the hydraulic circuit.

In the case of an axial piston machine type of hydraulic machine, a cylinder-barrel is mounted for rotation on a drive-shaft, and is provided with a number of generally axially aligned cylinder-bores. Each cylinder-bore contains a piston and each piston is operatively engaged to a swash-plate member. Arcuate-shaped ports in a valve-plate are arranged to be in fluid communication with fluid inlet and outlet conduits attached to the exterior of the machine, and thus rotary movement of the cylinder-barrel is accompanied by axial displacement of the pistons and corresponding displacement of fluid through these fluid conduits.

In machines of either type described above, pressurized fluid passing through the passages or openings provided in the housing shells can cause a number of problems such as fluid leakage through the material of the walls surrounding such passages or openings. If surface crack defects, or porosity in the material exist within such walls, an unacceptable high amount of fluid can escape to the outer environment of the machine. This is especially a problem when the housing shells are manufactured as aluminium pressure die-castings, because pressurized fluid has been known to seep through such castings if exposed in direct contact.

Furthermore, a solution shown in British Patent Application No. 9224046.4 (one of the priority applications in our co-pending PCT/GB93/01051) has attempted to overcome this problem by preventing pressurized fluid from coming into direct contact with the walls of the shells. In this solution, a hollow coupling-sleeve is used in combination with a deformable seal-ring. The action of tightening the hollow coupling-sleeve in the housing shell causes the seal-ring to become deformed at each of its ends against corresponding seats, such that once fully deformed against such seats, high-pressure fluid passing through both the hollow coupling-sleeve and ring-seal during operation of the hydrostatic machine is consequently prevented from directly contacting the surrounding walls of the housing shells.

However, this prior solution has been found to have a number of serious drawbacks, for instance:

The usual small dimensional imperfections found in manufacturing of all the inter-connecting components, in particular, when the longitudinal axes of the respective seats are not concentric with one another or become mis-aligned during machine assembly, will require a greater effort being used to sufficiently deform the ring-seal against the seats. Unless a leak-free seal is obtained, an unacceptably high fluid leakage results at these seats during machine operation, thereby preventing the machine from performing at the desired level of operating efficiency.

However, such greater effort when applied to sufficiently deform the ring-seal against the seats, can result in severe damage to the housing shell. For instance, by having to excessively tighten the hollow coupling-sleeve, the engagement threads provided in the shell become torn, and/or the resulting strain in the housing material causes cracks to appear in the relatively thin-walls of the shell. In either case, such damage may not be noticed during machine assembly, and may then only appear when the hydrostatic machine is operational and fluid loss to the environment is apparent. Subsequent repair to the machine may either be impossible or extremely costly to perform.

What is therefore required is an effective and reliable solution which overcomes all the prior difficulties and drawbacks described above.

It is therefore an object of the invention to provide the machine in which the pressurized fluid is prevented from direct exposure with the openings provided in the housing shells, that does not require high dimensional or positional accuracy between the joining parts, is economic to perform without relying on the deformation of any of the parts towards obtaining a leak-free seal, and does not impose undue loads in the housing shell structure that could result in cracking or other failure.

SUMMARY OF THE INVENTION

From one aspect the invention consists in a housing for a hydraulic piston hydrostatic machine having a drive-shaft, comprising two shells connectable together along a parting plane on which the rotating axis of the drive-shaft lies and wherein each said shell is provided with at least one opening, said openings arranged perpendicular to said parting plane and connecting the interior and exterior in each of said shells together.

A non-deformable liner-element is postioned within at least one of said openings to connect the internally disposed pintle-valve valve with an external fluid conduit in the case of a radial piston machine, or to connect the internally disposed valve-plate with an external fluid conduit in the case of an axial piston machine. Thus the non-deformable liner-element effectively lines the opening that already exist in the shell. In the case of a uni-flow directional machine, only one liner-element is fitted, whereas in the case of a reversible-flow machine, two such liner-elements may be used. The non-deformable liner-elements in effect, contain within the high pressure fluid entering or leaving the machine, and thereby prevents the high pressure fluid from directly contacting the opening provided in the housing shell.

As a further feature of the invention, a pair of flange-elements may be included, each attachable to an exterior surface provided on the shells and containing within a main fluid passageway that accepts a fluid conduit so that the machine may be attached to and used to service a hydraulic circuit. The flange-elements, although separable from their respective shell surfaces initially, become fastened to the respective shell surfaces when the machine is in the fully assembled condition. Furthermore, by such means, the flange-elements act as a clamp to aid in retaining the two shells together, and where an auxiliary fluid passageway may be included in one of the flange-elements to communicate with the control-system of the machine.

As a still further feature of the invention, the non-deformable liner-element transfers fluid from the internal working elements of the machine to the main fluid passageway provided in the flange-element.

A still further feature of the invention discloses the use of primary and secondary mounting-flanges on the exterior surface of the housing shells. The primary mounting-flange is used to attach the machine to a complementary surface that is provided for instance, on a prime-mover, whereas the secondary mounting-flange allows a second hydraulic machine to be attached to primary machine. In the radial piston type of machine, a self-aligning bearing may be located near the outer end of the pintle-valve in the primary machine for applications demanding a high degree of side-load at the protruding driving end of the drive-shaft, for instance when when a gear or pulley is used to transfer power from a prime-mover to the machine.

A still further feature of the invention concerns improved means for the retaining the pistons and slippers together in such machines. In this invention, the usual end float found in prior art machines has been eliminated by means of including a resilient washer which imparts a slight pre-load between the piston and slipper components. As a result, noise and vibration typically found in prior art machines is reduced.

These and other features and objects of the invention will become more apparent from the description of the invention with reference to the accompanying drawings.

BRIEF DESCRIPTION OF THE DRAWINGS

The invention may be performed in various ways and one specific embodiment is now described by way of example with reference to the accompanying drawings, in which:

FIG. 5 is a longitudinal view of a hydrostatic piston machine according to the second embodiment of the invention.

FIG. 6 is a view along line IV—IV of FIG. 5.

FIG. 7 is a longitudinal view of a hydrostatic piston machine according to the third embodiment of the invention.

FIG. 8 is an end View along line V—V of FIG. 7.

BRIEF DESCRIPTION OF THE FIRST EMBODIMENT OF THE INVENTION

Figure 1:
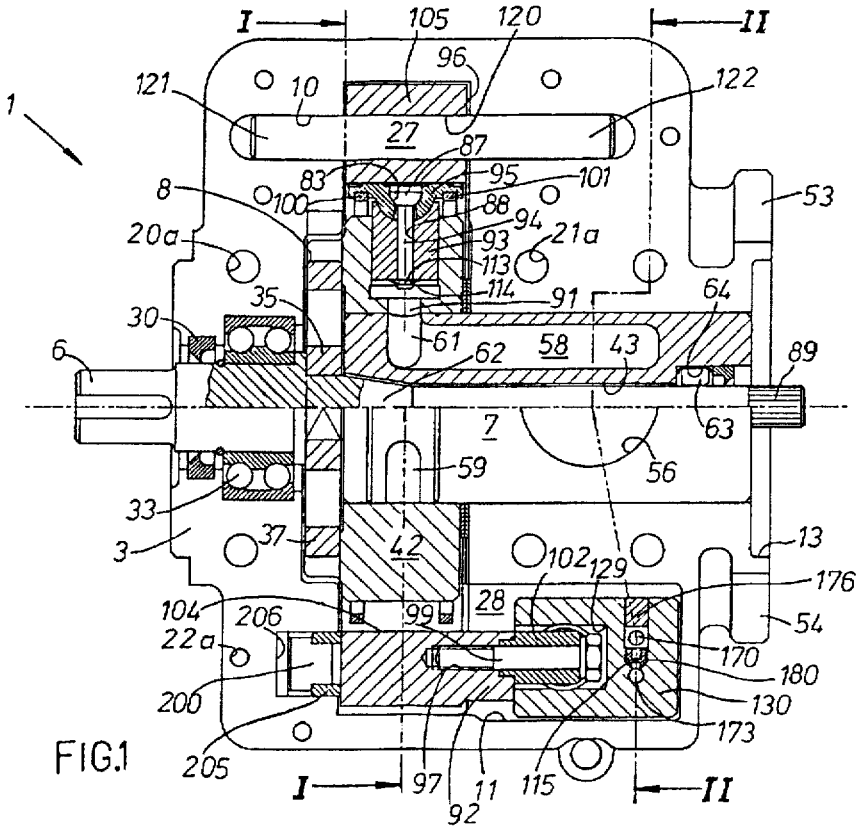
FIG. 1 is a longitudinal view of a hydrostatic piston machine according to the first embodiment of the invention.

In the first embodiment of the invention shown in FIGS. 1–4, the machine 1 comprises an outer housing structure which surrounds the internal working piston elements. The housing structure is formed by two shells 3, 4 of part-cylindrical form which interconnect with each other on a common parting-plane 5 along which the axes of the drive-shaft 6 and pintle-valve 7 will lie. Each shell 3, 4 is provided with an opening 69, 70 respectively, the openings intercommunicating the interior and exterior surfaces of each shell together.

Shell 3 is provided with one large semi-circular pocket 8 and a number of smaller semi-circular recesses such as those shown as 9, 11. Similarly shell 4 is also provided with an equal number of such pockets and recesses, shown for example, as pocket 16 and recesses 12, 17.

Figure 3:
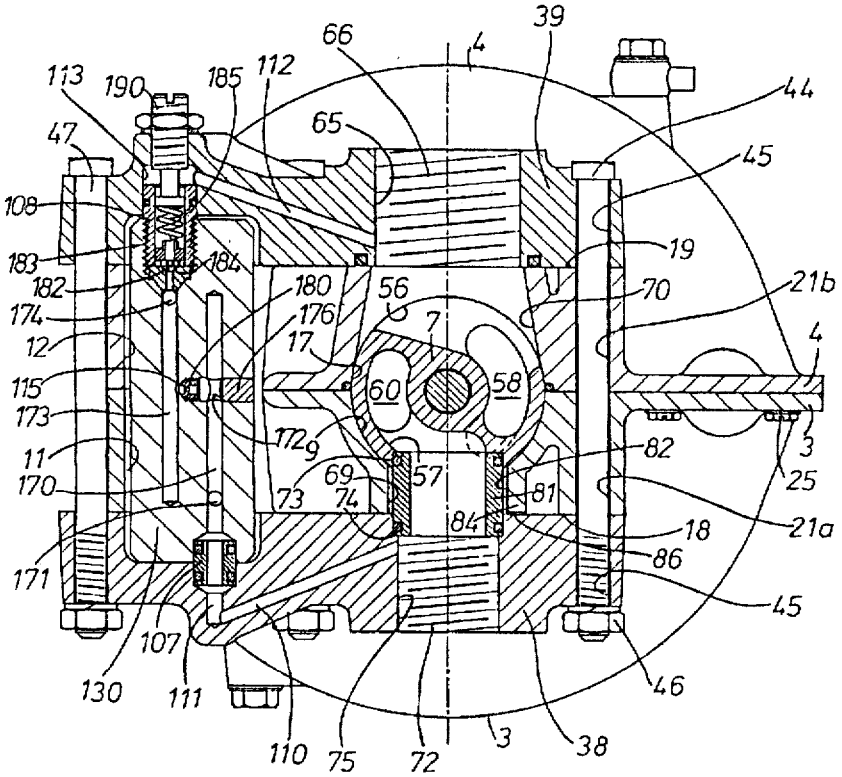
FIG. 3 is a cross sectional view along line II—II of FIG. 1.
Figure 4:
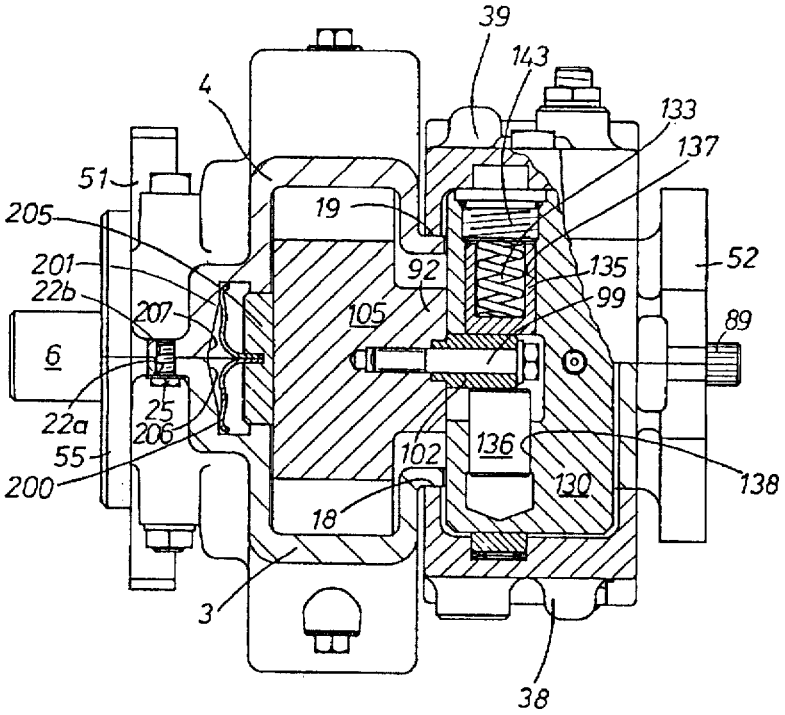
FIG. 4 is a longitudinal view along line III—III of FIG. 2.
Figure 9:
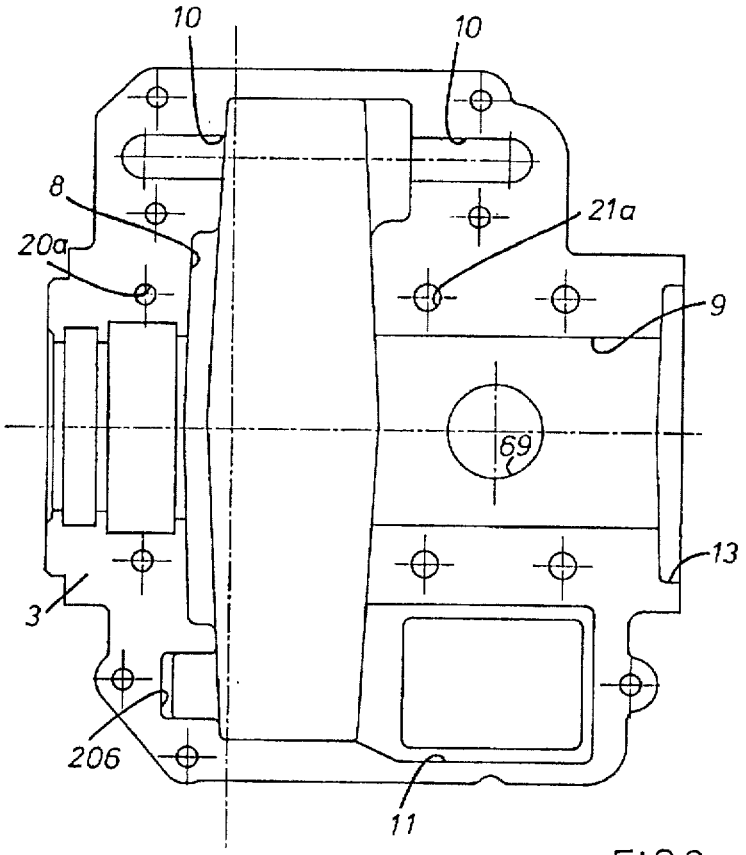
FIG. 9 is a plan view showing the interior of one of the housing shells according to the invention.
Figure 10:
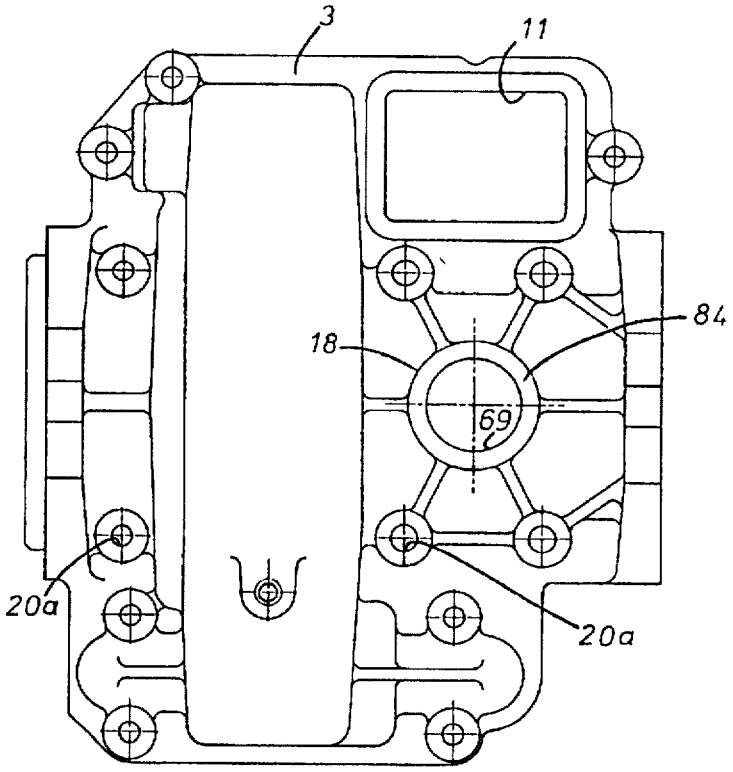
FIG. 10 is a plan view showing the exterior of one of the housing shells.
Figure 11:
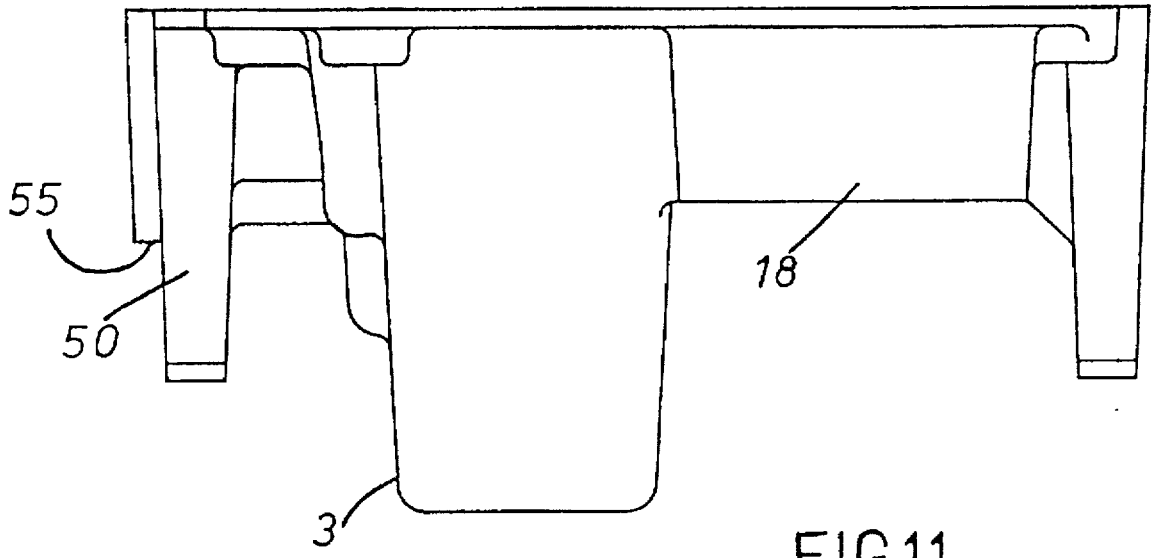
FIG. 11 is a side view showing the exterior of one of the housing shells.
Figure 12:
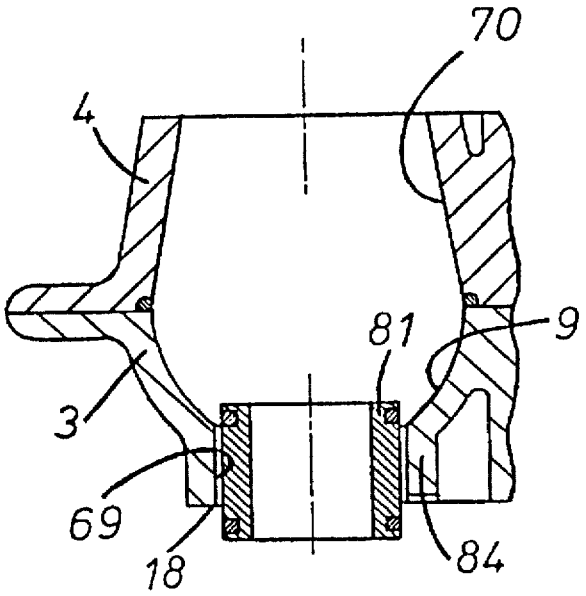
FIG. 12 shows the positioning of the non-deformable liner-element in the housing shells.

Attachment points are provided in both shells, for instance, holes 20*a*, 21*a*, 22*a* in shell 3 to correspond with a similar number of holes in shell 4, shown for example as hole 22*a* in FIG. 3 and hole 22*b* in FIG. 4.

The exterior of each shells 3, 4 is provided with a flat mounting face 18, 19 onto which respective flange-element 38, 39 are attached.

Once all the internal elements of the machine 1 have been positioned in place in the interior of shell 3, for instance, in such pockets and recesses shown as 8, 9, 11, anaerobic-sealant is applied, for instance, by the well known process called "silk-screening", to the upper exposed surface of shell 3 as shown in FIG. 1 along which lies the parting-plane 5. Shell 4 is then lowered onto shell 3 along parting-plane 5, and a number of self-threading screws 25 are attached, as shown for example in FIG. 4, for holes 22*a*, 22*b*. Flange-elements 38, 39, preferably manufactured in iron or steel, are then attached to their respective mounting faces 18, 19 provided on an exterior surface of the shells 3, 4, and bolts 44 inserted through holes 21*b*, 21*a*, 45 to engage with nuts 46. A further bolt 47 is also used as shown in FIG. 3. Once all the self-threading screws 25 and bolts 44, 47 have been tightened, shells 3, 4 are thus locked together to form the housing structure for the machine 1.

Thus when shells 3, 4 are together, respective recesses in each shell combine to form complete apertures, for instance, recesses 8, 16 combining as an aperture which forms the internal-chamber 26 of the machine. Likewise, recesses 9, 17 combine to form an aperture which surrounds the pintle-valve 7. After the anaerobic sealant has cured, the resulting internal-chamber 26 is sealed from the outer surrounding environment.

Further recesses are formed in each respective shell 3, 4 and are used to support other internal elements of the machine, for instance, recess 10 in shell 3 combines with a corresponding recess (not visible) in shell 4 creating an aperture that provides a support surface for the pivot-pin 27. Similarly, recesses 11, 12 combine together to provide an internal sub-chamber 28 for the various internal elements that comprise the displacement control-system mechanism for the machine 1.

In order to provide a mounting surface for the purpose of attaching the hydraulic machine to a remote and separate structure, each shell 3, 4 is provided with outwardly extending arms (only arm 50 visible in FIG. 2), which once the shells 3, 4 are together, provide a first mounting-flange member 51.

To allow a further hydrostatic machine to be attached to the first hydrostatic machine 1, a second mounting-flange member 52 is included at the rear end of machine 1. In this case, each shell combines with the other shell to form the outwardly extending arms 53, 54 as shown in FIG. 1. As shown, the outwardly extending arms 53, 54 of the second mounting-flange member 52 may be arranged to be perpendicular to those outwardly extending arms 50 of the first mounting-flange member 51.

Register 55 is provided on the first mounting-flange member 51 and similarly, a register 13 is provided on the second mounting flange-member 52.

DESCRIPTION OF THE INTERNAL ELEMENTS

A shaft-seal 30 is positioned between shells 3, 4 to surround the drive-shaft 6 in order to prevent any fluid escaping from the internal-chamber 26.

Respective shells 3, 4 combine to form an internal cylindrical location pocket for a bearing, such as ball-bearing 33 which provides support for drive-shaft 6.

For applications where two or more hydrostatic machines need to be driven from the same drive-shaft, drive-shaft 6 may be waisted in diameter in the region shown as 62 thereby allowing it to extended through the interior (hollow passage 43) of the pintle-valve 7 to protrude at 89 from the rear side of the machine 1 for coupling to a drive-shaft of a second hydrostatic machine (not shown). A self-aligning bearing 63 is located within a pocket 64 provided in the pintle-valve 7 so to provide further support for drive-shaft 6.

Figure 2:
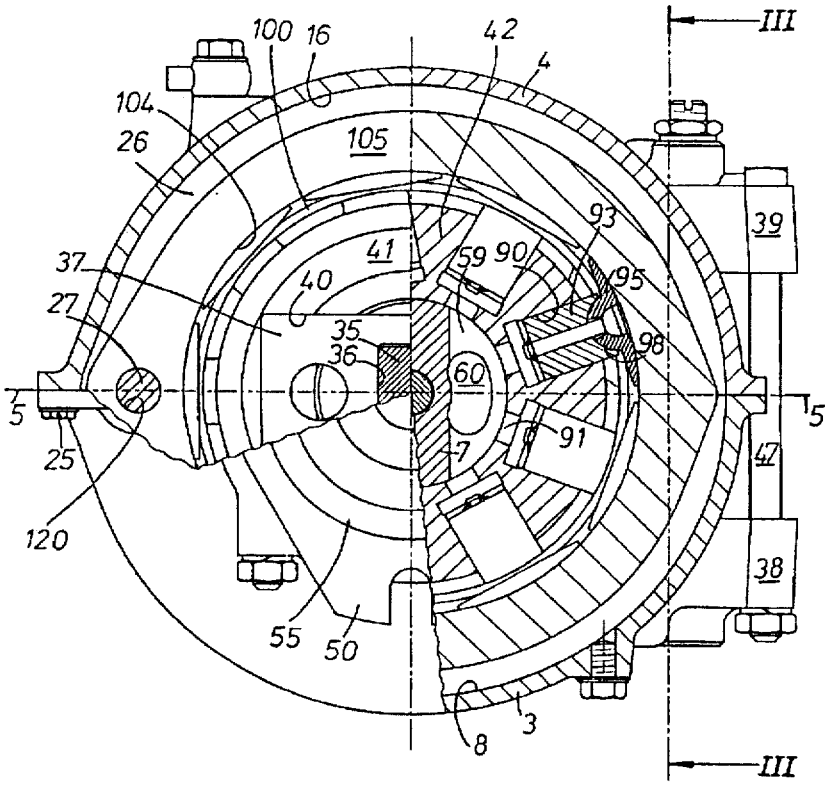
FIG. 2 is a cross sectional view along line I—I of FIG. 1.

As shown in FIG. 2, a tongue 35 is provided on drive-shaft 6 which fits into a corresponding slot 36 provided in an "oldham" type misalignment coupling 37. The coupling 37 fits into a slot 40 provided on the end face 41 of the cylinder-barrel 42, and acts to compensate for any inaccuracy that may exist between the respective axes of the drive-shaft 6 and pintle-valve 7.

As shown in FIG. 3, two pintle-ports 56, 57 are provided in pintle-valve 7, and where pintle-port 56 is connected by an internal longitudinal bore 58 to arcuate-port 61. Pintle-port 57 is connected by an internal longitudinal bore 60 to arcuate-port 59.

Flange-element 39 has a low-pressure fluid admittance passageway 65 which interfaces with opening 70 provided in shell 4. Opening 70 is so positioned in shell 4 to be linked or joined with pintle-port 56 in the pintle-valve 7. The longitudinal axes of both passageway 65 and opening 70 are substantially coincident, and thereby arranged to be perpendicular to the parting-plane 5 of the machine 1. Passageway 65 is threaded 66 in order to accept a suitable external fluid-conduit (such as a pipe) which thereby can connect the machine 1 to a hydraulic circuit. Similarly, flange-element 38 has a high-pressure fluid discharge passageway 75 which is threaded 72 in order to accept a suitable external fluid-conduit.

Opening 69 provided in shell 3 is so positioned to be able to join with both passageway 75 and pintle-port 57. Location recesses 73, 74 are provided in both the pintle-valve 7 and flange-element 38 as shown in FIG. 3 for the non-deformable liner-element 81. Non-deformable liner-element 81 extends through opening 69 and acts to fluidly couple pintle-port 57 to passageway 75, thereby effectively lining opening 69 to prevent the surrounding wall 84 of shell 3 from being subjected to high pressure fluid.

In the event of any small amount of pressurized fluid contained within non-deformable liner-element 81 escaping, for instance, should the non-deformable liner-element 81 rupture during machine operation, a drainage groove 86 is provided that connects the annular cavity 82 surrounding the non-deformable liner-element 81 to the internal chamber 26 of the machine 1. Thus any leakage of pressurized fluid is caused to become de-pressurised immediately on entering annular cavity 82. As a result, there is no likelihood of the housing structure failing, as pressurized fluid is prevented from gaining access to the parting-plane 5 between the shells 3, 4, which could otherwise cause the shells 3, 4 to become prized apart and separated.

The cylinder-barrel 42 is supported for rotation on the pintle-valve 7 and includes a number of cylinder-bores 90 each connected through a respective "necked" cylinder-port 91 to allow fluid distribution between each of the cylinder-bores 90 and a respective pair of elongate arcuate-ports 59, 61 formed on the periphery of the pintle-valve 7.

Each cylinder-bore 90 contains a piston 93 which is attached to a respective slipper 95 by means of a rivet 94. The longitudinal or shank portion of the rivet 94 is a relatively close fit inside an axial longitudinal hole provided in the piston 93, so allowing the required amount of pressurized fluid from cylinder-bore 90 to reach the bearing-face of the slipper 95 for the creation of a hydrostatic bearing in a manner well know in the art. Pistons 93 and slippers 95 mate together on a part-spherical socket 98 to allow articulation of the slipper 95 on the piston 93.

The rivet 94 has a head 87 at one end which is allowed to articulate in a female pocket 83 provided in the interior of the slipper 95. The rivet 94 may be provided with a groove 113 at a location on the shank portion just proud from the base of the piston 93 as shown in FIG. 1, and where a resilient retaining-ring 114 engages into groove 113 to hold the piston 93 and slipper 95 together in their assembled state. Alternatively, the resilient retaining-ring may be of the Starlock type, which can be placed over the shank portion of the rivet without the aid of a groove.

Guidance-rings 100, 101 are provided and serve to keep the slippers 95 in close proximity with the annular surface 104 of the track-ring 105. This feature combined with the centrifugal force on the piston/slipper serves to enhance the suction characteristics of this type of hydrostatic machine.

The track-ring 105 is provided with a hole 120 into which pivot-pin 27 is located, pivot-pin 27 being extended at either end 121, 122 to protrude from hole 120 to be supported directly in shells 3, 4. Thereby the track-ring 105 is supported within the machine and allowed limited articulated movement about the pivot-pin 27. Although not shown, hollow cylindrical-collars may be fitted over the protruding ends 121, 122 of pivot-pin 27, to reduce the pressure loading imposed on the shell material.

A boss 92 is provided on one end face 96 of the track-ring 105 into which a threaded hole 97 is provided. A control-pin comprising a bolt 99 and collar 102 is included, and where the bolt 99 locates into the threaded hole 97 to hold the collar 102 against the end face of boss 92. The collar 102 projects into a cavity 129 provided in the interior of a manifold-block 130, and where the collar 102 is engaged on opposite sides by actuating servo-rams 135, 136 as shown in FIG. 4.

The manifold-block 130 comprises the main component of the displacement control system for the machine 1, shown positioned between shells 3, 4 and attached to respective flange-elements 38, 39 by means of a hollow-sleeve 107 and the body portion 108 of the pressure relief-valve 183.

Servo-ram 135 is purposely designed to be larger in diameter than servo-ram 136, each being fitted into a respective cylinder 137, 138 in the manifold-block 130. Coil-spring 133 is located behind servo-ram 135 in cylinder 137 so that during periods when the machine 1 operates at low-pressure, the spring 133 biases track-ring 105 to its maximum eccentric position. Plug 143 is used to close off cylinder 137 in manifold-block 130.

In flange-element 38, channels 110, 111 are provided which communicate fluid from the discharge passageway 75 by way of hollow-sleeve 107 to manifold-block 130. Also a channel 112 and chamber 113 are provided in flange-element 39 allowing fluid to be communicated from the manifold-block 130 to the admittance passageway 65 for reasons as will be explained below.

In manifold-block 130, five channels 170, 171, 172, 173, 174 are provided, and where plugs (only plug 176 visible for conduit 172) are used to close the ends of the channels 170, 172, 174.

The fluid from the discharge side of the machine 1 on entering hollow sleeve 107, flows into channels 170, 171, and where channel 171 leads to a cylinder 138 which contains the small servo-ram 136, and thereby, cylinder 138 is always maintained at the same pressure level as in the high-pressure discharge passageway 75.

Fluid can also pass from channel 171 into an intersecting channel 172 in which is contained the body portion 180 of a fluid throttling orifice 115. Any fluid passing through orifice 115 enters channel 173, from where it can act against the poppet-head 182 of pressure relief-valve 183. Channel 174 intersects with channel 173 so that fluid can also gain access into the cylinder 137 containing the large servo-ram 135.

During periods when the relief-valve 183 remains "closed", fluid in channels 173, 174 is maintained at the same pressure level as the fluid contained in channels 171, 172 up-stream of the orifice 115. Because servo-ram 135 is larger in area than servo-ram 136, the resulting force produced by servo-ram 135 is greater than the resulting force produced by servo-ram 136, and as a consequence, servo-ram 135 is predominant in determining the degree of eccentricity of the track-ring 105.

During periods when the fluid discharge pressure level from the machine 1 is sufficiently high that the pressurized fluid within channel 173 causes poppet-head 182 to lift off its seat 184 (compressing coil-spring 185), the relief-valve 183 is "opened". Fluid in channels 173, 174 can then flow through chamber 113 and channel 112 to be returned to low-pressure fluid admittance passageway 65 of the machine 1.

As the pressure level in channels 173, 174 falls in value below that still experienced in channels 170, 171, 172 up-stream of the orifice 115, the pressure level acting behind the large area servo-ram 135 is now lower in magnitude than the pressure level acting behind the smaller area servo-ram 136.

Thereby the resulting force produced by the small area servo-ram 136 is now greater than the resulting force produced by large area servo-ram 135, and this causes the small area servo-ram 136 to slide in a a direction towards the open end of its cylinder 138 to move the collar 102, thereby causing the track-ring 105 to partially rotate about the pivot-pin 27 so reducing eccentricity of the track-ring 105 relative to the pintle-valve 7. Therefore, during this condition, the small area servo-ram 136 becomes predominant in determining the degree of eccentricity of the track-ring 105.

By such movement, the servo-rams 135, 136 respond to pressure levels in the hydraulic circuit to cause alterations in the degree of eccentricity of track-ring 105 and corresponding alteration in the fluid discharge output from the machine 1.

For the displacement control system of the machine 1 to operate successfully, the level of pressure of the fluid in channels 173, 174 is dependent on both the "cracking" pressure setting of the relief-valve 183 and the amount of induced pressured-drop across the orifice 115, and these act to determine the amount of pressure differential between cylinders 137, 138.

The orifice 115 also prevents a large amount of pressurized fluid passing between channels 170, 173, so that only a small amount of hydraulic energy is lost from high-pressure discharge passageway 75. As a result, even during periods when the relief-valve 183 is "open", the overall volumetric efficiency performance of the machine still remains high.

In order to maintain the track-ring 105 is close relationship with the manifold-block 130, clearance-adjusting means comprising two bent-spring wire-clips 200, 201 are used, which act against a pad 205 to bias track-ring 105 against the adjacent face of the manifold-block 130. The recesses 206, 207 provided in respective shells 3, 4 are purposely angled in order to allow the spring-clips 200, 201 to curl-up on themselves to provide tensioning means as soon as the shells 3, 4 are locked together during assembly. As a result, any clearance that may exist between the track-ring 105 and manifold-block 130 is removed, thereby preventing these components from unduly vibrating during the operation of the machine 1.

Operation of the Machine

The operation of the machine 1 is as follows: Rotation of the drive-shaft 6 causes the cylinder-barrel 42 to rotate. If track-ring 105 is set in an eccentric relationship to the pintle-valve 7, outward sliding movement of the pistons 93 in their respective cylinder-bores 90 is obtained, such that fluid from some external source, such as a hydraulic reservoir, is drawn in via the low-pressure fluid admittance passageway 65 to pintle-port 56, longitudinal bore 58, arcuate-port 61 to the interior of cylinder-bore 90 via "necked" cylinder-port 91. When the piston 93 returns inwards in its cylinder-bore 90, the fluid is expelled from the interior of cylinder-bore 90 via "necked" cylinder-port 91 into the opposite arcuate-port 59 from where it in directed along longitudinal bore 60 to reach pintle-port 57. The fluid then passes through non-deformable liner-element 81 to reach the high-pressure fluid discharge passageway 75 for coupling by a conduit to service a hydraulic circuit, such as a hydraulic motor. During periods when the poppet-head 182 of relief-valve 183 remains loaded against its seat 184 by coil-spring 185, fluid delivery pressure from the high-pressure fluid discharge passageway 75 of the machine 1 is received by both servo-rams 135, 136 acting against the collar 102. As the large servo-ram 135 (down-stream of the throttle-valve 180) is larger in area than the small servo-ram 136, the resultant force from the large servo-ram 135 on the collar 102 is sufficient to keep the track-ring 105 in an eccentric relationship to the pintle-valve 7. However, when the force generated by fluid pressure on the poppet-head 182 is greater than the tension of the coil-spring 185, the poppet-head 182 is lifted from its seat 184 to "open" the relief-valve 183 and release fluid to the low-pressure fluid admittance circuit of the machine 1. As a consequence, the pressure level acting behind the large servo-ram 135 falls in value such that it is no-longer sufficient to hold the track-ring 105 in its initial position. Thus the force of the small servo-ram 136 is now greater than the force acting behind the large servo-ram 135, so that small servo-ram 136 now becomes the effective controller of the machine 1, and the eccentricity of the track-ring 105 relative to the pintle-valve 7 is reduced from the initial position. As the small servo-ram 136 remains at delivery pressure whereas the level of pressure acting on the large servo-ram 135 is governed by the magnitude of the pressure drop across orifice 115, the opposing forces on the projecting collar 102 of the track-ring 105 are sufficient to keep the vibration of the track-ring 105 to a very low levels. When the track-ring 105 is moved into a concentric relationship with the pintle-valve 7, the pistons 93 no-longer reciprocate in their respective cylinder-bores 90, and fluid is no-longer displaced through the machine 1.

By this simple and inexpensive means, the pump displacement is controlled with a high degree of stability and accuracy. In order to change the operating characteristics of the machine 1, the tension of coil-spring 185 can be adjusted by means of screw 190.

BRIEF DESCRIPTION OF THE SECOND EMBODIMENT OF THE INVENTION

In the second embodiment of the invention shown in FIGS. 5 & 6, the hydrostatic machine 220 is of the axial piston type and comprises two shells 221, 222 of part-cylindrical form which connect together on parting-plane 224 along which the axis of the drive-shaft 225 lies. As for the first embodiment, all the working elements of the hydrostatic machine are contained within the surrounding housing shells when in their assembled condition.

The drive-shaft 225 is supported by bearings 227, 228 and carries a cylinder-barrel 230 near its mid-point. The cylinder-barrel 230 is rigidly connected to the drive-shaft 225 and therefore rotates at equal speed.

The cylinder-barrel 230 is provided with a plurality of axially arranged cylinders 231, each cylinder 231 communicating through a port 232 provided at one end of the cylinder-barrel 230 to become fluidly coupled to a pair of timing-slots 236, 237 formed in a stationary valve-plate 240. The ports 232 and timing-slots 236, 237 thereby can transfer liquid flowing between the valve-plate 240 and the rotating cylinder-barrel 230. Within each cylinder 231, a piston 242 is disposed, each piston 242 has at one end a spherical-head 244 which is mounted into a complementary-shaped socket 245 formed in the slipper 246.

The swash-plate 250 substantially is semi-cylindrically-shaped 251 on one side and has a flat surface 252 on the other side to which the slippers 246 are in operational engagement.

The semi-cylindrically-shaped surface 251 of the swash-plate 250 is engaged in an arcuate surface 255 provided in an end support-member 256 that is fixedly held in place between the two shells 221, 222 of the machine 220.

The inclination of the swash-plate 250 can be varied by turning the adjustment-shaft 259 which carries at its inner end a lever 260 having a tongue 261 that fits into a slot 262 provided in the swash-plate 250. As the tongue 261 moves in slot 262, the action causes partial rotation of the swash-plate 250 about arcuate surface 255 in the end support-member 256 and thereby the inclination angle of swash-plate 250 is changed with respect to the longitidinal reciprocating axis of the pistons 242.

Each of the two timing-slots 236, 237 in the valve-plate 240 connect with respective holes 262, 263, the ends of each of the holes 262, 263 being provided with a screw-thread 265, 266.

Preferably, two non-deformable liner-elements 270, 271 are used is this machine 220, and they are broadly cylindrical in shape and have a hollow interior 272, 273, and where at least at one end, they are preferably threaded 275, 276.

Non-deformable liner-element 270 is thereby inserted through opening 283 provided in shell 221 to protrude into internal chamber 290, and by means of having a thread 275 at its inner most end, it is connected to a complementary threaded hole 265 provided in the valve-plate 240. Similarly, non-deformable liner-element 271 is inserted through opening 284 in shell 222 to connect, by means of its threaded end 276, the complementary threaded hole 266 provided in the valve-plate 240. With the application of a thread lock and seal compound such as manufactured by the Loctite company, these connections are leak-free, and high-pressure fluid is prevented from escaping from holes 262, 263 inside the valve-plate 240.

Where the outer cylindrical form 280, 281 of each non-deformable liner-element 270, 271 is surrounded by the respective openings 283, 284, sealing compound may be applied at this interface to prevent liquid leaking out of internal chamber 290. Alternatively, a sealing device such as an 'O' ring may be used at this interface.

That end of the non-deformable liner-element 270 which protrudes out from shell 221 may be provided with a threaded-end 292 for connection to an external fluid conduit (such as a pipe) linking the machine 220 to a hydraulic circuit. Likewise, that end of non-deformable liner-element 271 may also be provided with a threaded-end 293 to connect with a fluid conduit.

The action of the non-deformable liner-elements 270, 271 once installed in the machine 220 also provides location for the valve-plate 240 by means of the threaded connection between all three components. As a result, the liquid interface between the valve-plate and external fluid conduits is performed without the risk of the high-pressure liquid coming into direct contact with the housing shells 221, 222 of the machine 220.

Rotation of the drive-shaft 225 causes the cylinder-barrel 230 to rotate. When the swash-plate 250 is inclined with respect to the rotational axis of the machine 220, the pistons 242 reciprocate within their cylinders 231, and liquid is displaced through the machine 220. For instance, when piston 242 moves in a direction away from the valve-plate 240, a partial vacuum is created in its cylinder 231 and this causes fluid to be drawn into the machine 220 through non-deformable liner-element 270 from external fluid conduit (not shown). The liquid passing through the hollow interior 272 of non-deformable liner-element 270 to pass into hole 262 and timing-slot 236 in the stationary valve-plate 240 and into port 232 leading to the cylinder 231 of the moving piston 242.

During the later part of the cycle as the piston 242 moves in a direction towards the valve-plate 240, and the liquid within the cylinder 232 is expelled via port 232 into the opposite timing-slot 237 in valve-plate 240. From here the fluid flows into hole 263 and through the hollow interior 263 of non-deformable liner-element 271 to a connecting fluid-conduit (not shown) that may be attached to the threaded end 293.

BRIEF DESCRIPTION OF THE THIRD EMBODIMENT OF THE INVENTION

The third embodiment of the invention shown in FIGS. 7 & 8 discloses an axial piston machine 300 of the same general type as already described in the second embodiment, but where in this case, both non-deformable liner-elements 301, 302 have now been re-positioned so as to be coincident with parting-plane 305 between the two housing shells 306, 307.

To ease explaination, the top housing shell 306 has been removed in FIG. 7 in order to show the internal components of the machine 300.

As shown in FIG. 8, two semi-circular recesses 307, 308 are provided in shell 306, and similarly, two semi-circular recesses 309, 310 are provided in shell 307.

Once the shells 306, 307 are assembled together, respective pairs of semi-circular recesses 307, 309 and 308, 310 form complete pockets shown as 311 and 312 respectively.

Pocket 311 is arranged to completely surround the outer cylindrical form 315 of non-deformable liner-element 301, whereas pocket 312 surrounds the outer cylindrical form 316 of non-deformable liner-element 302.

The nature of each of the non-deformable liner-element 301, 302 used in this embodiment are identical to those already described for the second embodiment. Essentially both non-deformable liner-elements 301, 302 have hollow interiors 317, 318, and are threaded at each end shown respectively as threads 320, 321 and 322, 323.

Likewise, both non-deformable liner-element 301, 302 operate in similar manner by connecting external fluid conduits (not shown) to internal threaded holes 325, 326 provided in an internally disposed valve-plate 327.

Sealing compound may be applied to the interface between respective pockets 311, 312 and cylindrical forms 315, 316 and once cured, creates a leak-free boundary such that liquid inside internal chamber 330 is prevented from seeping out at this interface.

A plurality of bolts, such as bolt 333 shown in FIG. 8, are inserted through holes, such as holes 334, 335 to hold shells 306, 307 together in the assembled condition.

Accordingly, all three embodiments described in this invention exhibit the same general improvement in that high-pressure liquid is contained within the non-deformable liner-elements such that the high-pressure liquid passing into and out of the machine is thereby unable to come into direct contact with the openings provided in the housing shells. As a result, the housing shells may be economically manufactured in aluminium by the pressure die-casting process without any risk from the high-pressure liquid causing problems, for instance, either by the forces exerted by the pressurized liquid creating cracks in the relatively thin walls of the shells, or through the occurance of leakage should the walls of the shells be slightly porous.

I claim:

1. In a hydrostatic piston machine of the positive displacement type, a housing having a drive-shaft for the transmission of mechanical power comprising: two shells connectable together along a parting-plane in which the rotating axis of said drive-shaft extends and the interior of each said shell is formed with a number of generally semi-circular recesses, respective pairs of said recesses form recesses to receive internal elements of said hydrostatic piston machine, and at least one opening is formed in at least one of said shells for intercommunicating said interior with an exterior surface of said shells; a non-deformable liner-element positioned within at least one of said openings and extending through said opening and preventing high-pressure fluid passing through said hydrostatic piston machine from coming into direct contact with said opening; and wherein said internal elements of said hydrostatic piston machine convert said mechanical power at said drive-shaft into hydraulic power passing through said non-deformable liner-element.

2. In a hydrostatic piston machine of the positive displacement type according to claim 1 wherein one end of said non-deformable liner-element is engageable to any one of said internal elements.

3. In a hydrostatic piston machine of the positive displacement type according to claim 1 wherein one end of said non-deformable liner-element is for threaded engagement to any one of said internal elements.

4. In a hydrostatic piston machine of the positive displacement type according to claim 1 wherein said shells are manufactured as aluminum die-castings and where said non-deformable liner-element is constructed from a non-porous material.

5. In a hydrostatic piston machine of the positive displacement type according to claim 1 wherein said non-deformable liner-element has its longitudinal axis arranged perpendicular to said parting-plane.

6. In a hydrostatic piston machine of the positive displacement type according to claim 1 wherein said non-deformable liner-element has its longitudinal axis arranged to be substantially coincident with said parting-plane.

7. In a hydrostatic piston machine of the positive displacement type according to claim 1 and including a plurality of radially arranged cylinders in a cylinder-barrel; a pintle-valve located between said shells and including a pair of pintle-ports positioned adjacent to said openings; a pair of flange-elements located on an exterior surface of said shells, each said flange-element formed with a passageway positioned adjacent to a said opening and wherein said non-deformable liner-element extends through said opening to provide a high pressure path between one said pintle-port and one said passageway.

8. In a hydrostatic piston machine of the positive displacement type according to claim 7 wherein a plurality of holes are provided in both said shells and said flange-elements, said holes having their longitudinal axes arranged perpendicular to said parting plane; and where retaining means are inserted through said holes to sandwich said shells between said flange-elements when said hydrostatic piston machine is in an assembled condition.

9. In a hydrostatic piston machine of the positive displacement type according to claim 7 wherein said pintle-valve is held in place between generally semi-circular support surfaces provided on each of the respective said shells.

10. In a hydrostatic piston machine of the positive displacement type according to claim 7 including a control-mechanism for varying the displacement of said hydrostatic piston machine; and wherein said passageway in at least one said flange-element is arranged to be in fluid communication with said control-mechanism.

11. In a hydrostatic piston machine of the positive displacement type according to claim 1 and including a plurality of axially arranged cylinders in a cylinder-barrel; and wherein an internally disposed valve-plate is held in position within said shells by means of at least one of said non-deformable liner-elements.

12. In a hydrostatic piston machine of the positive displacement type according to claim 1 wherein first and second mounting-faces are provided on said exterior surfaces of both said shells, each said mounting-face comprises a pair of outwardly extending arms.

13. In a hydrostatic piston machine of the positive displacement type according to claim 1 and including a plurality of radially arranged cylinders in a cylinder-barrel; and wherein said drive-shaft is extended in length to pass through the center of a pintle-valve supported by a bearing located within said pintle-valve.

14. In a hydrostatic piston machine of the positive displacement type according to claim 1 and including a plurality of radially arranged cylinders in a cylinder-barrel; a pintle-valve located between said shells and including at least one pintle-port; at least one flange-element located on said exterior surface on one of said shells, said flange-element formed with a passageway positioned adjacent to said opening and wherein said non-deformable liner-element extends from said opening to connect with said passageway.

15. In a hydrostatic piston machine of the positive displacement type according to claim 14 including a control-mechanism for varying the displacement of said hydrostatic piston machine; and wherein said passageway in said flange-element is arranged to be in fluid communication with said control-mechanism.

16. In a hydrostatic piston machine of the positive displacement type according to claim 14 wherein a plurality of holes are provided in both said shells and said flange-element, said holes having their longitudinal axes arranged perpendicular to said parting-plane and parallel to the longitudinal axis of said non-deformable liner-element; and wherein retaining means are inserted through said holes to lock said shells and said flange-element together as one unitary item.

17. In a hydrostatic piston machine of the positive displacement type according to claim 1 and including a plurality of radially arranged cylinders in a cylinder-barrel, a piston disposed in each said cylinder and moveable therein, said pistons being operatively connected by means of an associated slipper to engage against a surrounding annular track-ring; a longitudinal hole provided in both said pistons and said slippers into which a rivet is located, said rivet having a head at one end which is contained within a pocket provided within said said slipper, and wherein the shank of said rivet protrudes past the end of said piston to be engaged by a resilient retaining-ring, said retaining-ring holding said piston and said slipper together in their assembled state and substantially eliminating any space between the said piston and said slipper.

18. In a hydrostatic piston machine of the positive displacement type, a housing having a drive-shaft for the input of mechanical power which said hydrostatic piston machine converts into hydraulic fluid movement comprising: two shells connectable together along a parting-plane in which the rotating axis of said drive-shaft extends, said shells defining a number of generally semi-circular recesses to form recesses to receive internal elements of said hydrostatic machine and wherein at least one said shell is provided with at least one opening, said opening arranged perpendicular to said parting plane and intercommunicating the interior to the exterior of said shell; a pintle-valve located between said shells and including at least one pintle-port; at least one flange-element located on an exterior surface on one of said shells, said flange-element formed with a passageway positioned adjacent to said opening and wherein a non-deformable liner-element extends through a said opening to provide a high pressure fluid path between said pintle-port and said passageway.

19. In a hydrostatic piston machine of the positive displacement type, a housing having a drive-shaft for the transmission of mechanical power comprising: two shells connectable together along a parting-plane in which the rotating axis of said drive-shaft extends, said shells defining a number of generally semi-circular recesses forming recesses to receive internal elements of said hydrostatic machine and together defining a chamber extending transversely to the said parting-plane for receiving a cylinder-barrel in a location for rotation by said drive-shaft, the adjacent portions of said shells on one side of said location defining a mounting for said drive-shaft and the said adjacent portions of said shells on the other side of the said location defining at least one opening; a non-deformable liner-element positioned within at least one of said openings and extending through said opening and preventing high-pressure fluid passing through said hydrostatic piston machine from coming into direct contact with said opening; and wherein said internal elements of said hydrostatic piston machine convert said mechanical power at said drive-shaft into hydraulic power passing through said non-deformable liner-element.

20. In a hydrostatic piston machine of the positive displacement type according to claim 19 wherein said shells are manufactured as aluminum die-castings and where said non-deformable liner-element is constructed from a non-porous material.

* * * * *

UNITED STATES PATENT AND TRADEMARK OFFICE

CERTIFICATE OF CORRECTION

PATENT NO. :5,626,465

DATED :May 6, 1997

INVENTOR(S) :Christian Helmut THOMA

It is certified that error appears in the above-indentified patent and that said Letters Patent is hereby corrected as shown below:

On the title page, Item [56], insert the following references:

| | | |
|---|---|---|
| 1,266,606 | 5/21/18 | Manly |
| 1,308,436 | 7/1/19 | Maw et al. |
| 1,398,788 | 11/29/21 | Mayer |
| 1,721,225 | 7/1929 | Levering |
| 2,453,538 | 11/1948 | Rauch |
| 2,741,993 | 4/1956 | Orshansky |
| 2,818,707 | 1/7/58 | Sturm |
| 2,827,859 | 3/1958 | Crane |
| 3,044,412 | 7/17/62 | Orshansky, Jr. |
| 3,656,409 | 4/18/72 | Thomas et al. |
| 3,756,749 | 9/1973 | Aldinger |
| 3,955,477 | 5/1976 | Rutz |
| 4,056,'042 | 11/1977 | Rutz et al. |
| 4,091,717 | 5/1978 | Bojas et al. |
| 4,686,829 | 8/1987 | Thoma et al. |
| 4,893,524 | 1/90 | Ohashi et al. |
| 4,920,859 | 5/1990 | Smart et al. |
| 5,228,290 | 7/1993 | Speggiorin |
| 5,482,442 | 1/1996 | Blair et al. |

UNITED STATES PATENT AND TRADEMARK OFFICE

CERTIFICATE OF CORRECTION

PATENT NO. : 5,626,465

DATED : May 6, 1997

INVENTOR(S) : Christian Helmut THOMA

It is certified that error appears in the above-indentified patent and that said Letters Patent is hereby corrected as shown below:

Column 11, line 61, (Claim 1, line 19) change "liner-element." to --liner-element or vice versa.--.

Column 12, line 22, (Claim 7, line 7) after "element" insert --being--.

Column 14, line 34, (Claim 19, line 22) change "liner-element." to --liner-element or vice versa.--.

Signed and Sealed this

Twenty-sixth Day of August, 1997

*Attest:*

*Attesting Officer*

Bruce Lehman

BRUCE LEHMAN

*Commissioner of Patents and Trademarks*